US011166556B2

(12) United States Patent
Freisleben et al.

(10) Patent No.: US 11,166,556 B2
(45) Date of Patent: Nov. 9, 2021

(54) CHAIR WITH A SEAT AND A SUPPORT FRAME FOR SUPPORTING THE SEAT

(71) Applicant: VS VEREINIGTE SPEZIALMOEBELFABRIKEN GMBH & CO. KG, Tauberbischofsheim (DE)

(72) Inventors: Markus Freisleben, Wuerzburg (DE); Jens Heller, Gruensfeld (DE); Walter Richter, Grossrinderfeld (DE); Michael Scheller, Triefenstein (DE)

(73) Assignee: VS Vereinigte Spezialmoebelfabriken GmbH & Co. KG, Tauberbischofsheim (DE)

( * ) Notice: Subject to any disclaimer, the term of this patent is extended or adjusted under 35 U.S.C. 154(b) by 97 days.

(21) Appl. No.: 16/689,225

(22) Filed: Nov. 20, 2019

(65) Prior Publication Data

US 2020/0163459 A1 May 28, 2020

(30) Foreign Application Priority Data

Nov. 23, 2018 (DE) ..... 10 2018 129 550.2

(51) Int. Cl.
*A47C 4/03* (2006.01)
*A47C 5/04* (2006.01)
*A47C 5/12* (2006.01)

(52) U.S. Cl.
CPC ..... *A47C 4/03* (2013.01); *A47C 5/04* (2013.01); *A47C 5/12* (2013.01)

(58) Field of Classification Search
CPC .... A47C 3/04; A47C 3/12; A47C 4/02; A47C 4/03; A47C 5/04; A47C 5/10; A47C 5/12;
(Continued)

(56) References Cited

U.S. PATENT DOCUMENTS 7,380,879 B2 * 6/2008 Fletcher ..... A47C 3/12 16/42 R
8,757,725 B2 * 6/2014 Schneider ..... A47C 3/023 297/451.3
(Continued)

FOREIGN PATENT DOCUMENTS

DE 202010007149 U1 8/2010
DE 102016222653 A1 * 5/2018 ..... A47C 3/12
(Continued)

*Primary Examiner* — Ryan D Kwiecinski
(74) *Attorney, Agent, or Firm* — Laurence A. Greenberg; Werner H. Stemer; Ralph E. Locher

(57) ABSTRACT

A chair has a seat with a seat shell. A frame for supporting the seat has, on its side facing the seat, a mounting strut running parallel to the plane of the seat shell. An underside of the seat shell if formed with a receiving profile for the mounting strut. The receiving profile has a fastening section extending from a circumferential edge of the seat shell parallel to a plane of the seat shell into the interior of the seat shell and having an access opening at the circumferential edge of the seat shell. A clamping strip is provided for clamping the mounting strut in the fastening section. The clamping strip is slid from the access opening in a direction parallel to a longitudinal direction of the fastening section and is fixed in its end position in the fastening section perpendicular to the plane of the seat shell.

14 Claims, 8 Drawing Sheets

(58) Field of Classification Search
CPC ..... A47C 7/002; A47C 7/004; A47C 7/16; A47C 9/007; A47C 9/02
See application file for complete search history.

(56) References Cited

U.S. PATENT DOCUMENTS

| | | | | |
|---|---|---|---|---|
| 10,021,981 | B1 * | 7/2018 | Zheng | A47C 1/124 |
| 10,485,350 | B2 * | 11/2019 | Lenhart | A47C 9/002 |
| 2002/0047298 | A1 * | 4/2002 | Brauning | A47C 5/14<br>297/448.1 |

FOREIGN PATENT DOCUMENTS

| | | | | | |
|---|---|---|---|---|---|
| DE | 102016222653 | A1 | | 5/2018 | |
| DE | 202020002848 | U1 | * | 8/2020 | A47C 3/04 |
| EP | 1897467 | A1 | * | 3/2008 | A47C 3/12 |
| FR | 1494770 | A | | 9/1967 | |
| GB | 1176032 | A | * | 1/1970 | A47C 5/06 |
| GB | 1176032 | A | | 1/1970 | |
| WO | 2011029161 | A1 | | 3/2011 | |
| WO | WO-2011029161 | A1 | * | 3/2011 | A47C 4/02 |

* cited by examiner

CHAIR WITH A SEAT AND A SUPPORT FRAME FOR SUPPORTING THE SEAT

CROSS-REFERENCE TO RELATED APPLICATION

This application claims the priority, under 35 U.S.C. § 119, of German patent application DE 10 2018 129 550.2, filed Nov. 23, 2018; the prior application is herewith incorporated by reference in its entirety.

BACKGROUND OF THE INVENTION

Field of the Invention

The present invention pertains to a chair comprising a seat having a seat shell and a frame for supporting the seat.

By way of example, chairs have a seat with a seat shell and a frame for supporting the seat. For mounting the seat shell on the frame, the frame has, for example, on its side facing the seat, at least one mounting strut running parallel to the plane of the seat shell. In such a chair construction, it is known to provide the underside of the seat shell facing the frame with a receiving profile for form-fittingly receiving at least part of the mounting strut of the frame and to fix the mounting strut in the receiving profile with the aid of clamps screwed to the seat shell.

SUMMARY OF THE INVENTION

It is an object of the invention to provide a chair having an improved mounting system of the frame to the seat.

According to an aspect of the present invention, the chair comprises a seat having a seat shell and a frame for supporting the seat, wherein the frame comprises, on its side facing the seat, at least one mounting strut running parallel to the plane of the seat shell, and an underside of the seat shell facing the frame comprises a receiving profile for receiving at least part of the mounting strut of the frame. The chair of the present invention is characterized in that the receiving profile comprises a fastening section extending from a circumferential edge of the seat shell parallel to the plane of the seat shell into the interior of the seat shell and having an access opening at the circumferential edge of the seat shell, and there is provided a clamping strip for clamping the mounting strut in place in the fastening section of the receiving profile of the seat shell, which is slidable from the access opening of the fastening section at the circumferential edge of the seat shell into the fastening section on a side of the mounting strut of the frame facing away from the seat shell and in a direction parallel to a longitudinal direction of the fastening section and is fixed in an end position of the clamping strip in the fastening section in a direction perpendicular to the plane of the seat shell.

The chair according to the invention is characterized by a simply constructed mounting system for the frame to the seat, with which one or more mounting struts of the frame can be clamped in place in the receiving profile of the seat shell of the seat in a simple way. The clamping of the mounting strut(s) can be carried out by simply sliding the clamping strip(s) from the circumferential edge of the seat shell into the receiving profile and thus advantageously without additional tools (e.g. screwdriver, etc.) and without additional fastening elements (e.g. screws, etc.) in addition to the clamping strip.

Preferably, the receiving profile is formed as at least one recess or groove in the seat shell underside, i.e. it is located substantially completely within the thickness of the seat shell. Preferably, the receiving profile has no additional elements attached to or integrally formed with the underside of the seat shell which protrude from the underside.

In a preferred embodiment, the mounting strut of the frame is substantially form-fittingly received in the receiving profile of the seat shell. Preferably, the mounting strut of the frame is also form-fittingly clamped by the clamping strip.

In a preferred embodiment, the mounting strut is an integral part of the frame. Preferably, the mounting strut of the frame is designed in the form of a tube or a rod, preferably having a substantially circular cross-sectional shape. The material of the frame and its mounting strut is basically arbitrary, preferably selected from metal, plastic and wood. The material of the seat shell is basically arbitrary, preferably selected from plastic and wood, preferably manufactured as a plastic blow-molded shell. The material of the clamping strip is basically arbitrary, preferably metal or plastic.

In a configuration of the invention, the fastening section of the receiving profile comprises a first guiding element extending substantially parallel to the longitudinal direction of the fastening section, and the clamping strip comprises a second guiding element extending substantially parallel to the longitudinal direction of the fastening section and, in the end position of the clamping strip in the fastening section, engaging with the first guiding element on the fastening section. By the interlocking of the two guiding elements, the clamping strip is fixed in the fastening section of the receiving profile in a simple way in the direction perpendicular to the plane of the seat shell. The first guiding element extends optionally over the entire length, over a partial length or in sections over several partial lengths of the fastening section. The second guiding element extends optionally over the entire length, over a partial length or in sections over several partial lengths of the clamping strip.

Preferably, the second guiding element on the clamping strip engages with the first guiding element on the fastening section even during sliding the clamping strip into the fastening section. In this way, the mounting of the clamping strip can be simplified or supported.

In a configuration of the invention, the fastening section of the receiving profile comprises a first locking element, and the clamping strip comprises a second locking element which, in the end position of the clamping strip in the fastening section, engages with the first locking element on the fastening section in order to lock the clamping strip in the longitudinal direction of the fastening section.

The mounting concept of the invention for the frame to the seat allows the mounting strut of the frame and the clamping strip to be preferably embedded in the receiving profile of the seat shell. I.e. neither the mounting strut nor the clamping strip protrude noticeably from the underside of the seat shell. This has the advantage that with certain frame forms such as C-shaped chair legs, it is possible to stack several chairs on top of each other and/or place a chair with its seat on a table top (so-called "up-chairing") without any problems and without the risk of damaging the lower chair or the table top or the clamping strips. To achieve this, only a sufficient thickness of the seat shell and a sufficient depth of the receiving profile in the seat shell underside are to be provided.

In a configuration of the invention, the clamping strip comprises, on its side facing the seat shell, a receiving profile running parallel to the longitudinal direction of the fastening section and form-fittingly enclosing a circumferential section of the mounting strut.

In another configuration of the invention, the clamping strip comprises, on its side facing away from the seat shell, an intake groove in which an auxiliary element for sliding the clamping strip into the fastening section of the receiving profile and locking the clamping strip in the fastening section of the receiving profile can engage. In this way, the mounting of the clamping strip can be simplified or supported. The auxiliary element is, for example, a type of pin or bolt that can be hit, for example, with a hammer to drive the clamping strip into the fastening section.

In another configuration of the invention, there are provided a plurality of clamping strips for preferably form-fittingly clamping the mounting strut in a plurality of fastening sections of the receiving profile of the seat shell. In this way, the stability of the mounting of the mounting strut on the seat shell can be increased.

In case the frame of the chair comprises a plurality of mounting struts, preferably at least one fastening section in the receiving profile and at least one clamping strip are provided for each of this plurality of mounting struts.

In another configuration of the invention, the receiving profile has a plurality of different fastening sections for receiving mounting struts of differently designed frames. This means that one version of a seat or a seat shell can be used in combination with various versions of frames.

With the above and other objects in view there is also provided, in accordance with the invention, a system that includes a seat shell for a chair, wherein an underside of the seat shell comprises a receiving profile for receiving at least part of a mounting strut of a frame of the chair, and wherein the receiving profile comprises a fastening section extending from a circumferential edge of the seat shell parallel to the plane of the seat shell into the interior of the seat shell and having an access opening at the circumferential edge of the seat shell; and a clamping strip for clamping the mounting strut of the frame in place in the fastening section of the receiving profile of the seat shell, wherein the clamping strip is slidable from the access opening of the fastening section at the circumferential edge of the seat shell into the fastening section in a direction parallel to a longitudinal direction of the fastening section, and wherein the clamping strip is fixed in an end position of the clamping strip in the fastening section in a direction perpendicular to the plane of the seat shell.

With the above and other objects in view there is also provided, in accordance with the invention, a method for mounting a seat shell of a seat for a chair on a frame for supporting the seat, wherein the frame comprises, on its side facing the seat, at least one mounting strut running parallel to a plane of the seat shell, comprises providing an underside of the seat shell facing the frame with a receiving profile for receiving at least part of the mounting strut of the frame, wherein the receiving profile comprises a fastening section extending from a circumferential edge of the seat shell parallel to the plane of the seat shell into the interior of the seat shell and having an access opening at the circumferential edge of the seat shell; and clamping the mounting strut in place in the fastening section of the receiving profile of the seat shell by sliding a clamping strip from the access opening of the fastening section at the circumferential edge of the seat shell into the fastening section on a side of the mounting strut of the frame facing away from the seat shell and in a direction parallel to a longitudinal direction of the fastening section, wherein the clamping strip is fixed in an end position in the fastening section in a direction perpendicular to the plane of the seat shell.

Other features which are considered as characteristic for the invention are set forth in the appended claims.

Although the invention is illustrated and described herein as embodied in a chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
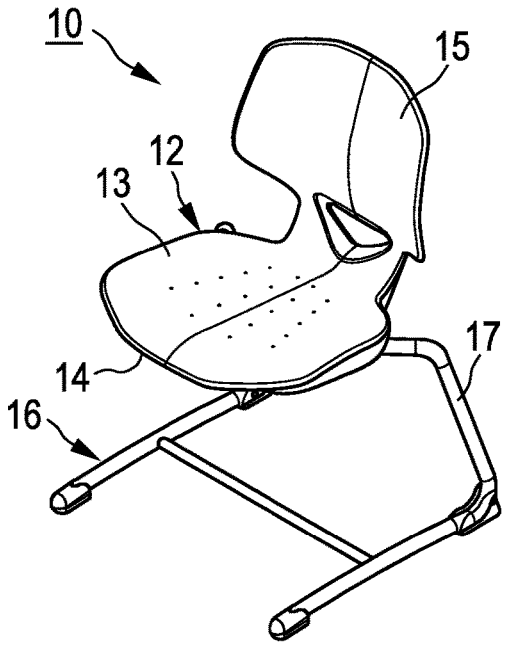
FIGS. 1A, 1B, 1C, and 1D show perspective views of chairs according to the present invention, equipped with different frames.

Referring now to the figures of the drawing in detail and first, particularly, to FIGS. 1A-1D thereof, there are shown several variants of a chair according to the invention having the same seat and different frames.

Each of the chairs 10 has a seat 12 with a seat shell 13 and a backrest 15 formed in one piece with the latter. The seat 12 is formed, for example, as a blow-molded shell made of plastic. The seat 12 is respectively supported by a frame 16, which is attached to an underside 14 of the seat shell 13.

Figure 1B:
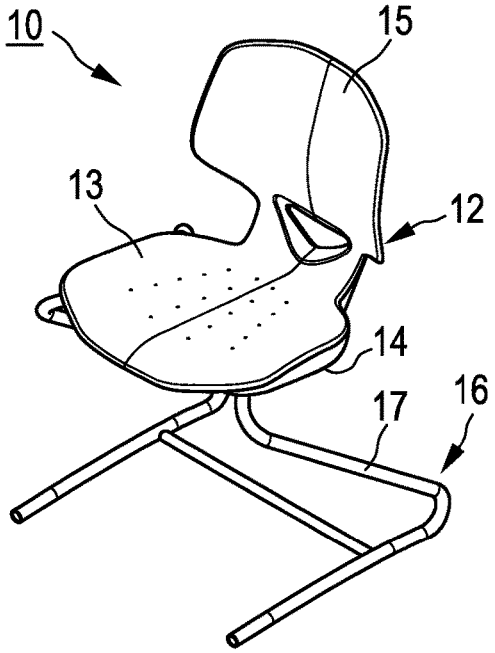
Figure 1C:
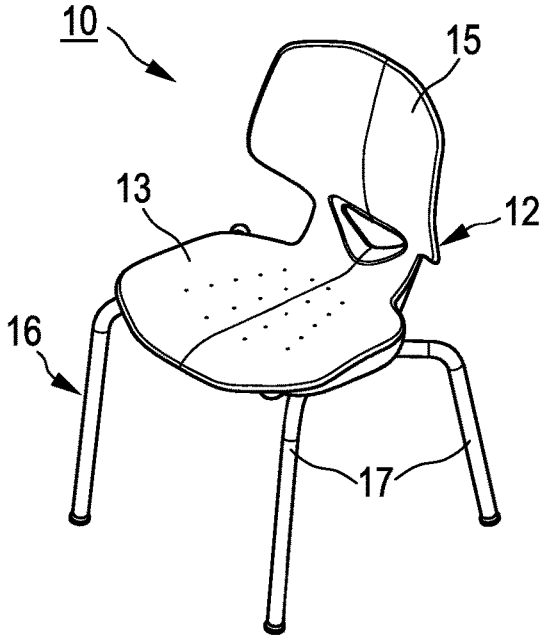
Figure 1D:
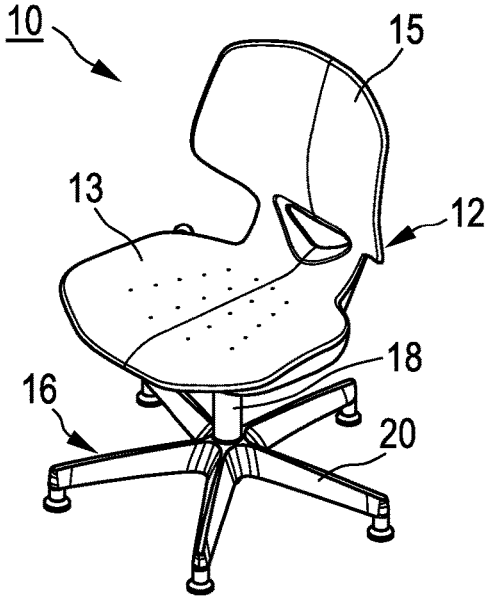

In FIG. 1A, the frame 16 has two chair legs 17 in C-shape which are connected to each other in the foot area and under the seat shell 13. In FIG. 1B, the frame 16 has two chair legs 17 in S-shape, which are connected to each other in the foot area and under the seat shell 13. In FIG. 1C, the frame 16 has four chair legs 17, which are connected to each other under the seat shell 13. In FIG. 1D, the frame 16 has a support column 18 on a cross base 20. The invention is not limited to these four frame types of FIGS. 1A-1D; the concept of the invention can also be applied in an analogous way to other frame types such as the so-called cantilever shape, etc.

Figure 2:
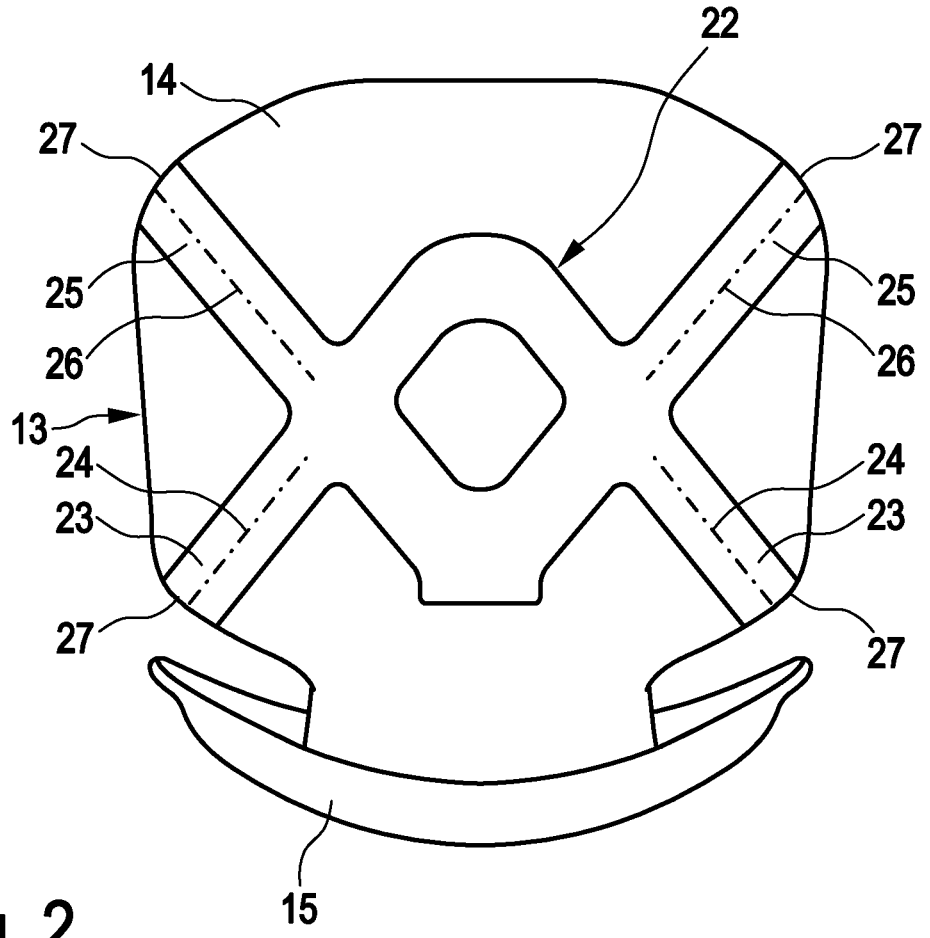
FIG. 2 shows a bottom view of a seat shell of a chair according to an embodiment of the invention.

FIG. 2 exemplarily shows an underside 14 of the seat shell 13 of the seat 12. In the underside 14 of the seat shell 13, there is provided an embodiment of a receiving profile 22 which is suited mounting all frames 16 of FIG. 1A-1D.

The receiving profile 22 is preferably formed by recesses or grooves in the underside 14 of the seat shell 13 so that it is located substantially completely within the thickness of the seat shell 13. The receiving profile 22 has several fastening sections 23, 24 each running from a circumferential edge of the seat shell 13 to the interior region of the seat shell 13. The two fastening sections 23 in the rear area of the seat shell 13 facing the backrest 15 each have a longitudinal direction 24; and the two fastening sections 25 in the front area of the seat shell 13 facing away from the backrest 15 each have a longitudinal direction 26. The fastening sections 23, 25 each start at an access opening 27 at the circumferential edge of the seat shell 13.

Figure 3A:
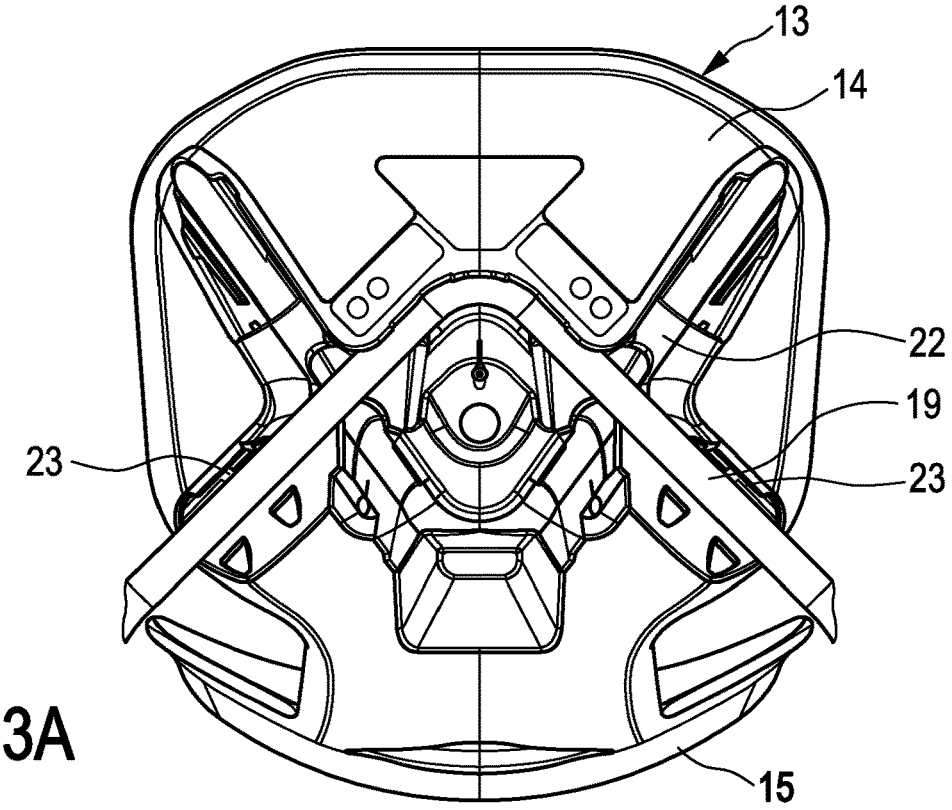
FIGS. 3A, 3B, 3C, and 3D are bottom views of the seat shell according to FIG. 2 with the mounting struts of different frames according to FIGS. 1A to 1D.

FIG. 3A exemplarily shows the course of a mounting strut 19 of the frame 16 of the chair 10 of FIG. 1A. The mounting strut 19 is connected to the two chair legs 17 of the frame 16 or formed in one piece with these, and runs substantially parallel to the plane of the seat shell 13. The mounting strut 19 is substantially form-fittingly received in the receiving profile 22 in the underside 14 of the seat shell 13, and runs through the two first fastening sections 23 of the receiving profile 22.

Figure 3B:
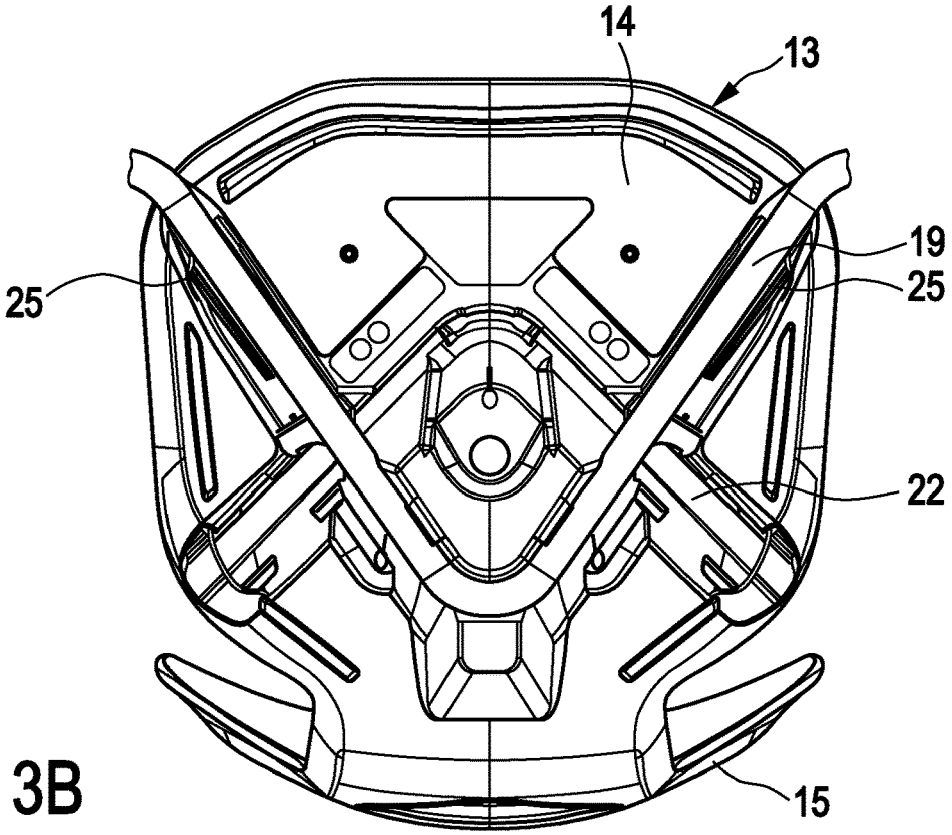

FIG. 3B exemplarily shows the course of a mounting strut 19 of the frame 16 of the chair 10 of FIG. 1B. The mounting strut 19 is connected to the two chair legs 17 of the frame 16 or formed in one piece with these, and runs substantially parallel to the plane of the seat shell 13. The mounting strut 19 is substantially form-fittingly received in the receiving profile 22 in the underside 14 of the seat shell 13, and runs through the two second fastening sections 25 of the receiving profile 22.

Figure 3C:
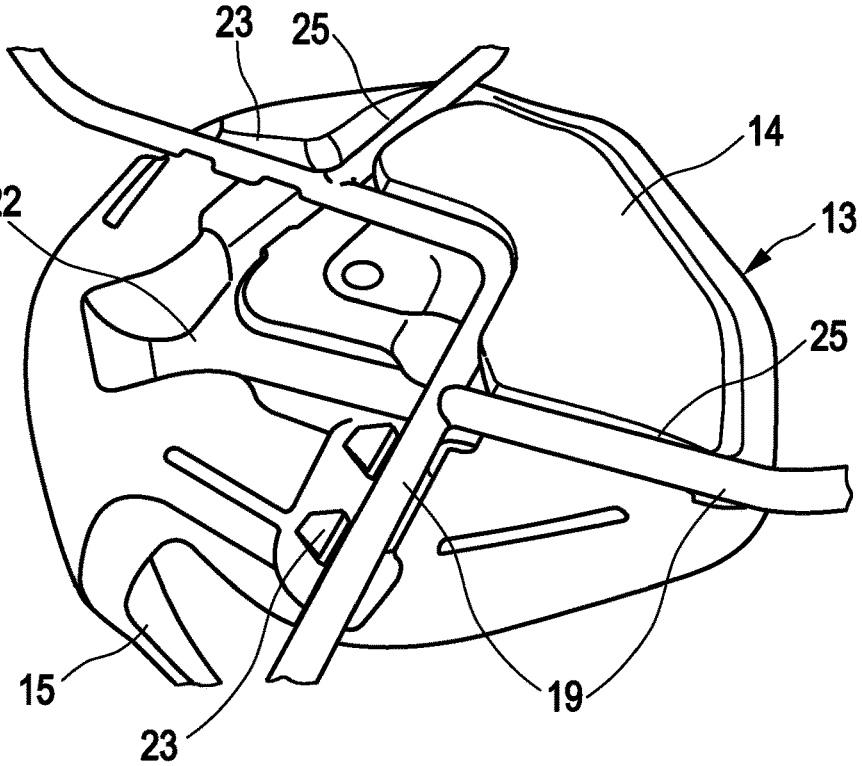

FIG. 3C exemplarily shows the course of the mounting struts 19 of the frame 16 of the chair 10 of FIG. 1C. The mounting struts 19 are connected to the four chair legs 17 of the frame 16 or formed in one piece with these, and each run substantially parallel to the plane of the seat shell 13. The mounting struts 19 are substantially form-fittingly received in the receiving profile 22 in the underside 14 of the seat shell 13, wherein the one mounting struts 19 run through the two first fastening sections 23 of the receiving profile 22, and the other mounting struts 19 run through the two second fastening sections 25 of the receiving profile 22.

In the design variants of FIGS. 3A-C, the mounting strut 19 of the frame 16 and also the respective clamping strip 30, 31 are embedded in the receiving profile 22 of the seat shell 13 or its fastening sections 23, 25, respectively. In other words, neither the mounting struts 19 nor the clamping strips 30, 31 protrude noticeably from the underside 14 of the seat shell 13, so that the underside 14 of the seat shell 13 remains substantially flat even with the mounted frame 16. This has the advantage that—depending on the overall shape of the frame—it is possible to stack several chairs 10 on top of each other and/or to place a chair 10 with its seat 12 on a table top (so-called "up-chairing") without any problems and without the risk of damaging (in particular scratching, etc.) the lower chair 10 or the table top or the clamping strips 30, 31, respectively.

Figure 3D:
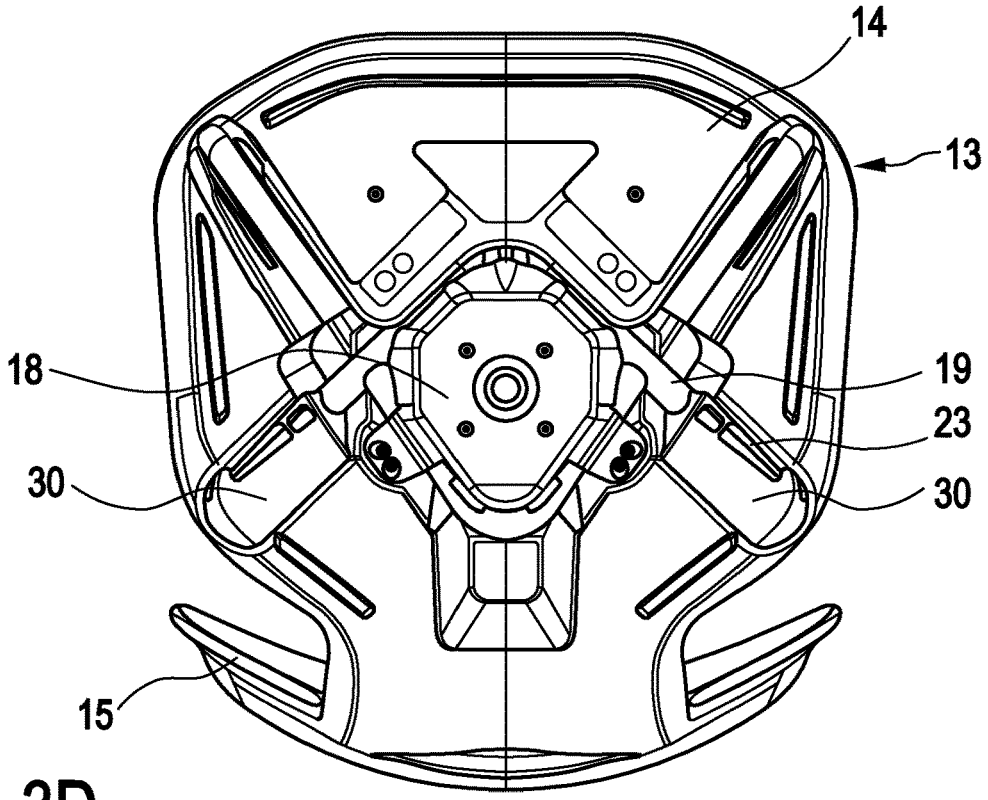

FIG. 3D exemplarily shows the mounting of the frame 16 of the chair 10 of FIG. 1D. The support column 18 is connected to several mounting struts 19 or formed in one piece with these, each running substantially parallel to the plane of the seat shell 13. The mounting struts 19 are substantially form-fittingly received in the receiving profile 22 in the underside 14 of the seat shell 13, wherein some of the mounting struts 19 run through the two first fastening sections 23 of the receiving profile 22 and some other of the mounting struts 19 run through the two second fastening sections 25 of the receiving profile 22.

Referring to FIGS. 4A-4D, the fastening of the frame 16 of the chair 10 of FIG. 1A to the seat shell 13 is exemplarily explained in more detail, wherein the course of the mounting strut 19 in the receiving profile 22 of the seat shell 13 corresponds to the illustration of FIG. 3A.

Figure 4A:
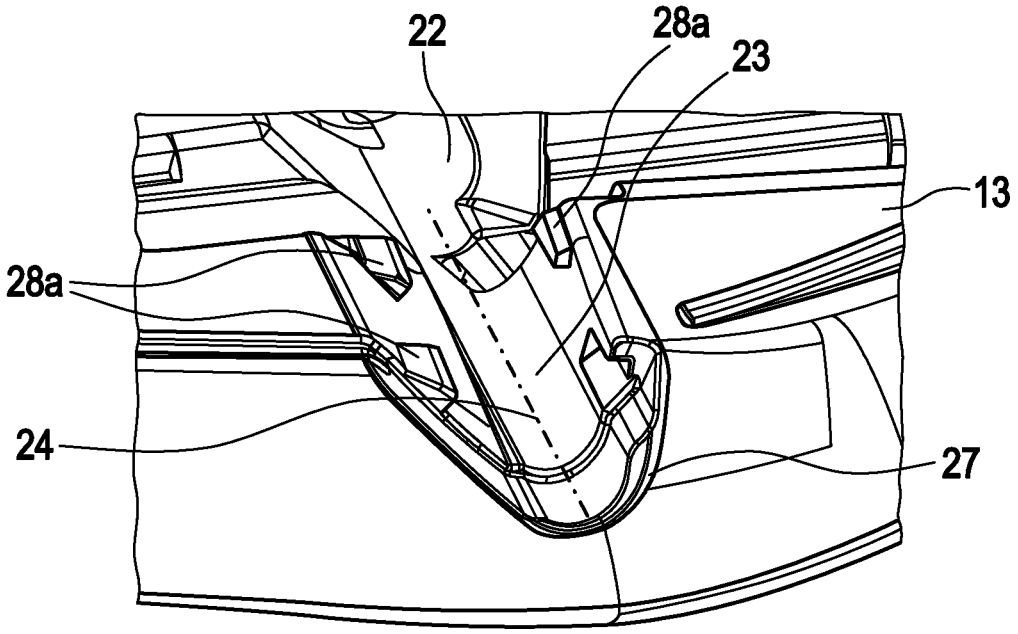
FIGS. 4A, 4B, 4C, and 4D are several perspective partial views of a mounting system of a mounting strut of the frame to the seat shell according to a first design variant of the invention.

FIG. 4A illustrates the fastening section 23 of the receiving profile 22. The fastening section 23 is formed by a recess or groove in the underside 14 of the seat shell 13 and is thus located completely within the thickness of the seat shell 13. The fastening section 23 has an access opening 27 at the circumferential edge of the seat shell 13, from which it runs along the longitudinal direction 24 parallel to the plane of the seat shell 13 into the interior of the seat shell 13. In the fastening section 23, there is provided a number of guiding edges 28*a* (first guiding elements in the sense of the invention), which run substantially parallel to the longitudinal direction 24 of the fastening section 23. In the embodiment of FIG. 4, these guiding edges 28*a* are provided on both sides with respect to the longitudinal direction 24 and each run in sections along the longitudinal direction 24. In the area below the guiding edges 28*a*, the mounting strut 19 can be substantially form-fittingly received in the fastening section 23.

Figure 4B:
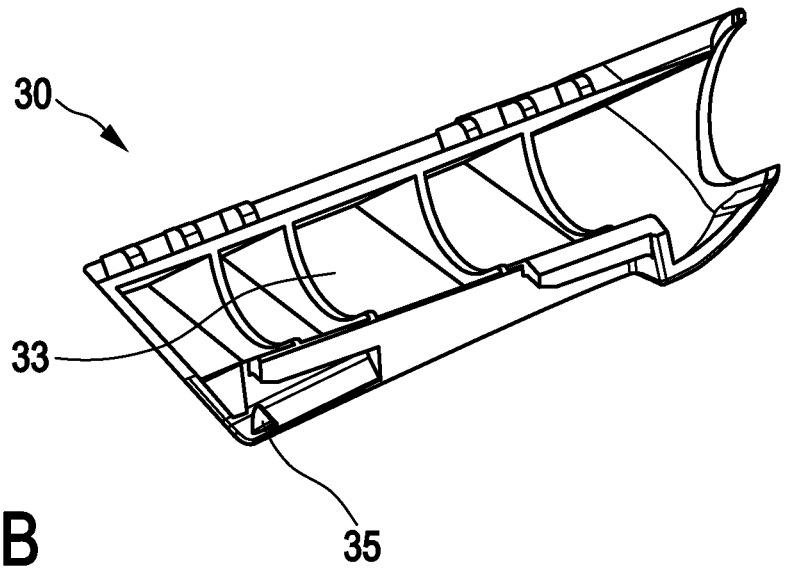

For clamping the mounting strip 19 in place in this fastening section 23 of the receiving profile 22, there is provided a clamping strip 30, which is exemplarily illustrated in FIG. 4B. The clamping strip 30 is, for example, made of hard plastic. The clamping strip 30 has a receiving profile 33, which can substantially form-fittingly enclose a circumference of the mounting strut 19.

Figure 4C:
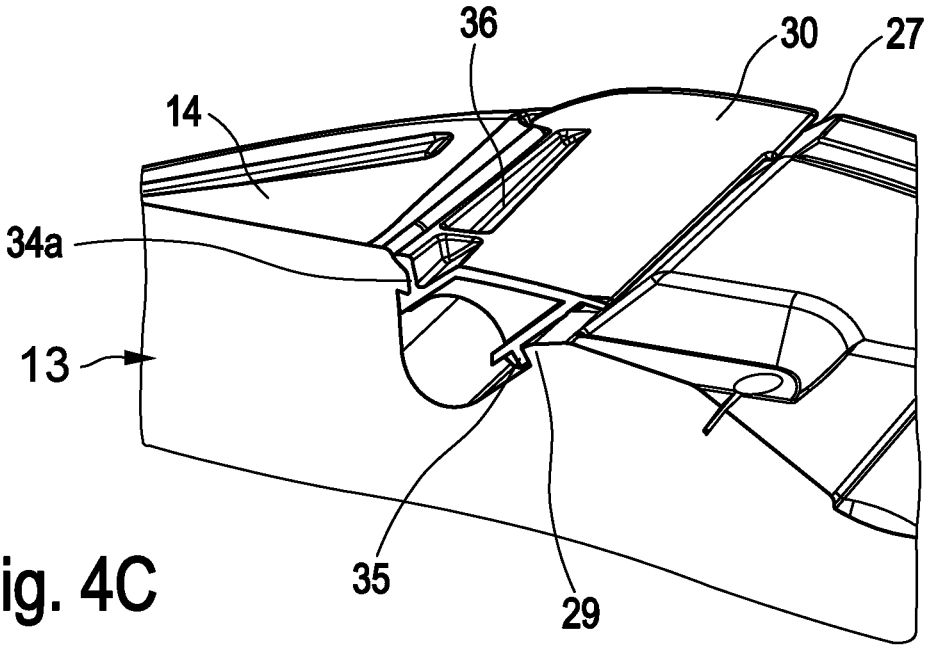

As illustrated in FIG. 4C, the clamping strip 30 can be slid from the access opening 27 of the fastening section 23 in the direction parallel to the longitudinal direction 24 of the fastening section 23 into the latter. Thereby, the mounting strut 19 (not shown in FIG. 4) is located in the fastening section 23 between the seat shell 13 and the clamping strip 30. The clamping strip 30 has guiding grooves 34*a* (second guiding element in the sense of the invention) on its outside extending substantially parallel to the longitudinal direction 24 of the fastening section 23. These guiding grooves 34*a* are in engagement with the guiding edges 28*a* on the fastening section 23 both during the sliding of the clamping strip 30 into the fastening section 23 as well as in the end position of the clamping strip 30 in the fastening section 23 shown in FIG. 4C. In this way, the guiding elements 28*a*, 34*a* support the sliding of the clamping strip 30 into the fastening section 23 and fix the clamping strip 30 in the direction perpendicular to the plane of the seat shell 13 in the fastening section 23 in order to clamp the mounting strut 19 of the frame 16 therein.

Figure 4D:
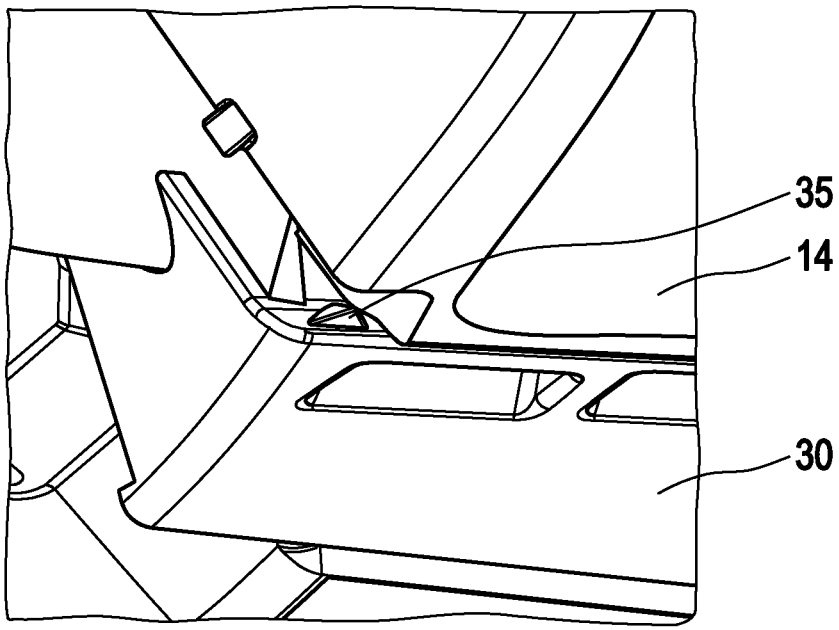

As shown in FIGS. 4B-4D, there is further provided a first locking element 29 in the fastening section 23, and there is further provided a second locking element 35 on the clamping strip 30. In the end position of the clamping strip 30 in the fastening section 23, these two locking elements 29, 35 engage with each other in order to lock the clamping strip 30 in the longitudinal direction 24 of the fastening section 23 in the latter.

Thus, the clamping strip 30 is, in its end position in the fastening section 23, locked in the direction perpendicular to the plane of the seat shell 13 as well as in the longitudinal direction 24 of the fastening section 23 and is thus fixed in the latter. Thus, the fastening of the mounting strut 19 of the frame 16 in the receiving profile 22 in the underside 14 of the seat shell 13 is secured.

As especially shown in FIG. 4C, in this embodiment, the recess of the receiving profile 22 and its fastening sections 23, respectively, project so far into the underside 14 of the seat shell 13 that the mounting strut 19 and also the clamping strip 30 are embedded in the receiving profile 22 or its fastening section 23, respectively, i.e. do not noticeable protrude from the underside 14 of the seat shell 13.

In order to simplify sliding and locking the clamping strip 30 into/in the fastening section 23, the clamping strip 30 optionally comprises an intake groove 36 on its outer side facing away from the seat shell 13. An auxiliary element, for example in the form of a bolt, can be pushed into this intake groove 36 and then be hit, for example, with a hammer to drive the clamping strip 30 into the fastening section 23.

Referring to FIGS. 5A-5D, mounting the frame 16 of the chair 10 of FIG. 1B to the seat shell 13 is exemplarily explained in more detail, wherein the course of the mounting strut 19 in the receiving profile 22 of the seat shell 13 corresponds to the illustration of FIG. 3B.

Figure 5A:
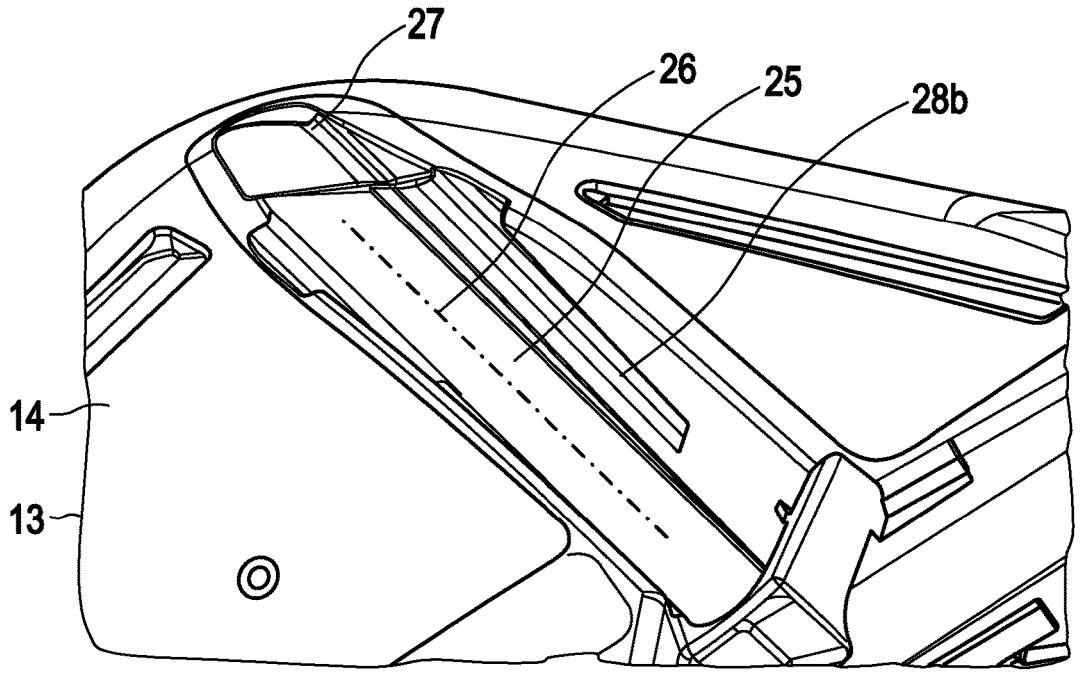
FIGS. 5A, 5B, 5C, and 5D are several perspective partial views of a mounting system of a mounting strut of the frame to the seat shell according to a second design variant of the invention.

FIG. 5A illustrates the fastening section 25 of the receiving profile 22. The fastening section 25 is formed by a recess or groove in the underside 14 of the seat shell 13 and is thus located completely within the thickness of the seat shell 13. The fastening section 25 has an access opening 27 at the circumferential edge of the seat shell 13, from which it extends along the longitudinal direction 26 parallel to the plane of the seat shell 13 into the interior of the seat shell 13. In the fastening section 25, there is provided a number of guiding grooves 28*b* (first guiding elements in the sense of the invention) running substantially parallel to the longitudinal direction 26 of the fastening section 25. In the embodiment of FIG. 5, these guiding grooves 28*b* are provided on both sides with respect to the longitudinal direction 26 and run along the longitudinal direction 26 in each case over a partial section of the fastening section 25. In this fastening section 25, the mounting strut 19 can be received substantially form-fittingly, i.e., with a positive lock or positively locking.

Figure 5B:
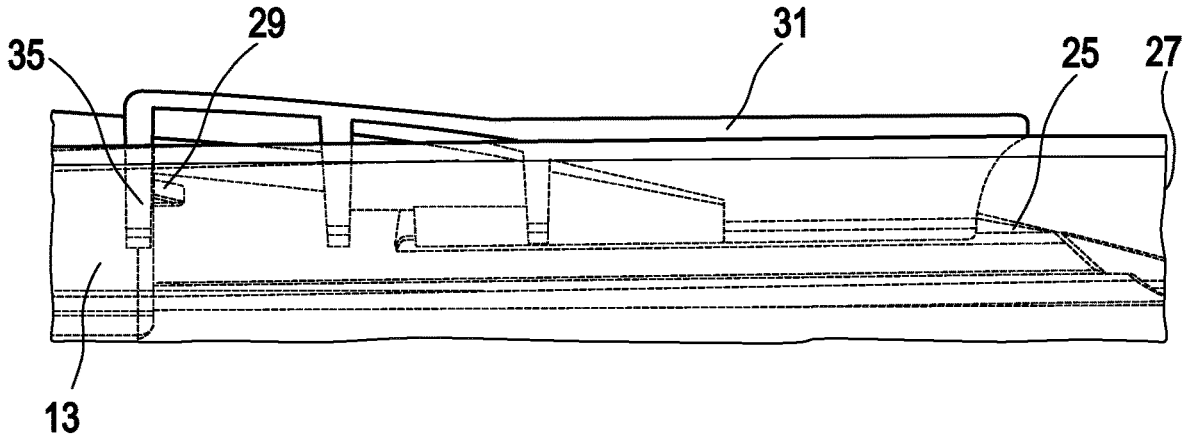

For clamping the mounting strut 19 in place in this fastening section 25 of the receiving profile 22, there is provided a clamping strip 31 which is exemplarily shown in FIG. 5B. The clamping strip 31 is, for example, made of hard plastic. The clamping strip 31 has a receiving profile 33, which can substantially form-fittingly enclose a circumference of the mounting strut 19.

Figure 5C:
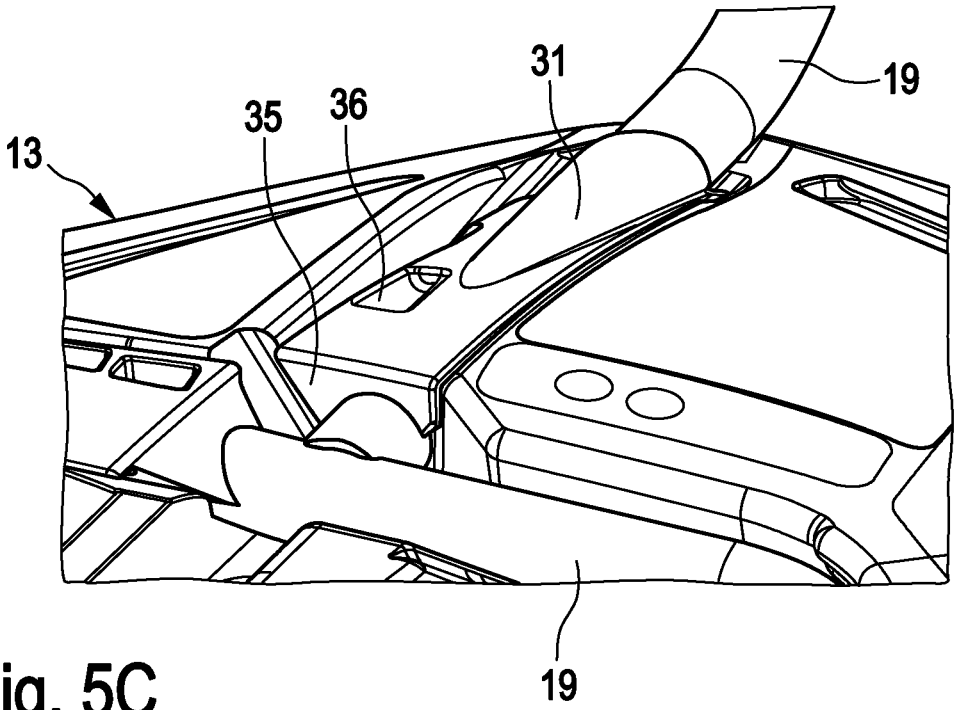
Figure 5D:
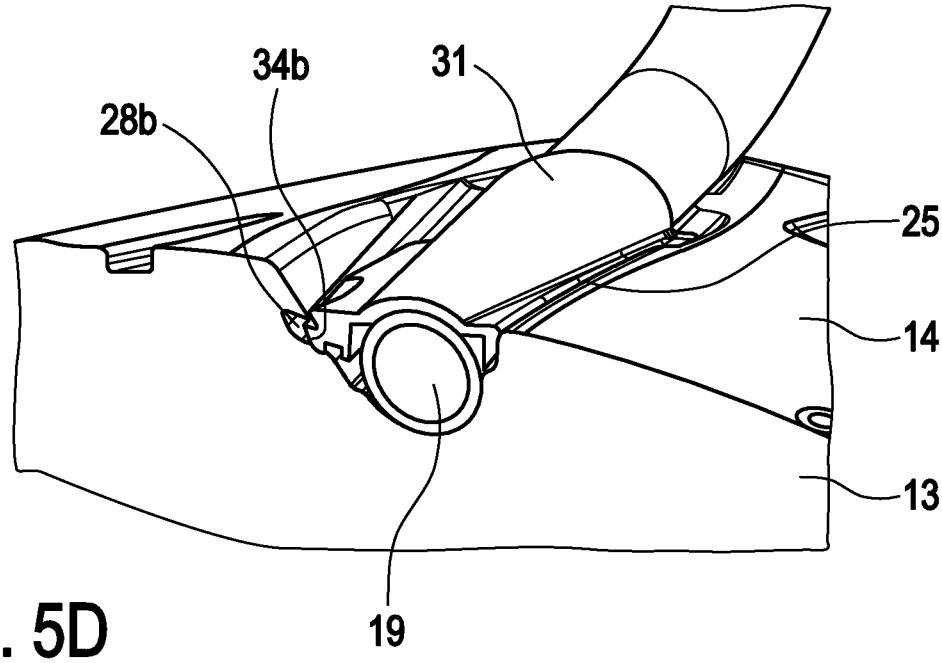

As illustrated in FIGS. 5C and 5D, the clamping strip 31 can be slid from the access opening 27 of the fastening section 25 in the direction parallel to the longitudinal direction 26 of the fastening section 25 into the latter. Thereby, the mounting strut 19 is located in the fastening section 25 between the seat shell 13 and the clamping strip 31. The clamping strip 31 has guiding edges 34*a* (second guiding element in the sense of the invention) on its outside extending substantially parallel to the longitudinal direction 26 of the fastening section 25. These guiding edges 34*b* are in engagement with the guiding grooves 28*b* in the fastening section 25 both during the sliding of the clamping strip 31 into the fastening section 25 as well as in the end position of the clamping strip 31 in the fastening section 25 shown in FIGS. 5C and 5D. In this way, the guiding elements 28*b*, 34*b* support the sliding of the clamping strip 31 into the fastening section 25 and fix the clamping strip 31 in the direction perpendicular to the plane of the seat shell 13 in the fastening section 25 in order to clamp the mounting strut 19 of the frame 16 therein.

As shown in FIGS. 5B and 5C, there is further provided a first locking element 29 in the fastening section 25, and there is further provided a second locking element 35 on the clamping strip 31. In the end position of the clamping strip 31 in the fastening section 25, these two locking elements 29, 35 engage with each other in order to lock the clamping strip 31 in the longitudinal direction 26 of the fastening section 25 in the latter.

Thus, the clamping strip 31 is, in its end position in the fastening section 25, locked in the direction perpendicular to the plane of the seat shell 13 as well as in the longitudinal direction 26 of the fastening section 25 and is thus fixed in the latter. Thus, the fastening of the mounting strut 19 of the frame 16 in the receiving profile 22 in the underside 14 of the seat shell 13 is secured.

In order to simplify sliding and locking the clamping strip 31 into/in the fastening section 25, the clamping strip 31 optionally comprises an intake groove 36 on its outer side facing away from the seat shell 13. An auxiliary element, for example in the form of a bolt, can be pushed into this intake groove 36 and then be hit, for example, with a hammer to drive the clamping strip 31 into the fastening section 25.

The features of the two design variants of FIGS. 4A-4D and FIGS. 5A-5D can optionally also be combined with each other.

The mounting of the frame 16 of the chair 10 of FIG. 1C or FIG. 1D to the seat shell 13 is a combination of the two mountings of FIGS. 4A-4D and FIGS. 5A-5D.

The invention claimed is:

1. A chair, comprising:

a seat having a seat shell and a frame for supporting said seat;

said frame, on a side thereof facing said seat, having at least one mounting strut running parallel to a plane of said seat shell;

said seat shell, on an underside thereof facing said frame, having a receiving profile for receiving at least a part of said mounting strut of said frame;

said receiving profile including a fastening section extending from a circumferential edge of said seat shell parallel to the plane of said seat shell into an interior of said seat shell and having an access opening at the circumferential edge of said seat shell; and a clamping strip for clamping said mounting strut in place in said fastening section of said receiving profile of said seat shell, said clamping strip being slidably insertable from said access opening of said fastening section at the circumferential edge of said seat shell into said fastening section on a side of said mounting strut of said frame facing away from said seat shell and in a direction parallel to a longitudinal direction of said fastening section and being fixable in an end position of said clamping strip in said fastening section in a direction perpendicular to the plane of said seat shell.

2. The chair according to claim 1, wherein:

said fastening section of said receiving profile comprises a first guiding element extending parallel to the longitudinal direction of said fastening section; and said clamping strip comprises a second guiding element extending parallel to the longitudinal direction of said fastening section and, in an end position of said clamping strip in said fastening section, engaging with said first guiding element on said fastening section.

3. The chair according to claim 2, wherein said second guiding element on said clamping strip engages with said first guiding element on said fastening section even during a sliding of said clamping strip into said fastening section.

4. The chair according to claim 1, wherein:

said fastening section of said receiving profile comprises a first locking element; and said clamping strip comprises a second locking element, which, in an end position of said clamping strip in said fastening section, engages with said first locking element on said fastening section in order to lock said clamping strip in the longitudinal direction of said fastening section.

5. The chair according to claim 1, wherein said mounting strut of said frame and said clamping strip are embedded in said receiving profile of said seat shell.

6. The chair according to claim 1, wherein said clamping strip comprises, on a side thereof facing said seat shell, a receiving profile running parallel to the longitudinal direction of said fastening section and form-fittingly enclosing a circumferential section of said mounting strut.

7. The chair according to claim 1, wherein said clamping strip comprises, on a side thereof facing away from said seat shell, an intake groove in which an auxiliary element for sliding said clamping strip into said fastening section of said receiving profile and locking said clamping strip in said fastening section of said receiving profile can engage.

8. The chair according to claim 1, wherein said clamping strip is one of a plurality of clamping strips for clamping said mounting strut in a plurality of fastening sections of said receiving profile of said seat shell.

9. The chair according to claim 1, wherein said at least one mounting strut of said frame is one of a plurality of mounting struts, and at least one fastening section in said receiving profile and at least one clamping strip are provided for each of said plurality of mounting struts.

10. The chair according to claim 1, wherein said receiving profile has a plurality of different fastening sections for receiving mounting struts of differently designed frames.

11. The chair according to claim 1, wherein said clamping strip is slideable in the parallel direction from said access opening over a length thereof into the end position.

12. A system, comprising:

a seat shell for a chair, said seat shell having an underside with a receiving profile for receiving at least a part of a mounting strut of a frame of said chair; and said receiving profile including a fastening section extending from a circumferential edge of said seat shell parallel to a plane of said seat shell into an interior of said seat shell and having an access opening at the circumferential edge of said seat shell; and a clamping strip for clamping the mounting strut of the frame in place in said fastening section of said receiving profile of said seat shell, wherein said clamping strip being slidable from said access opening of said fastening section at the circumferential edge of said seat shell into said fastening section in a direction parallel to a longitudinal direction of said fastening section; and said clamping strip is fixable in an end position of said clamping strip in said fastening section in a direction perpendicular to the plane of said seat shell.

13. The chair according to claim 12, wherein said clamping strip is slideable in the parallel direction from said access opening over a length thereof into the end position.

14. A method of mounting a seat shell of a seat for a chair on a frame for supporting the seat, wherein the frame has, on a side thereof facing the seat, at least one mounting strut running parallel to a plane of the seat shell, the method comprising:

providing an underside of the seat shell facing the frame with a receiving profile for receiving at least part of the mounting strut of the frame, wherein:

the receiving profile includes a fastening section extending from a circumferential edge of the seat shell parallel to the plane of the seat shell into the interior of the seat shell and the fastening section has an access opening at the circumferential edge of the seat shell; and clamping the mounting strut in place in the fastening section of the receiving profile of the seat shell by sliding a clamping strip from the access opening of the fastening section at the circumferential edge of the seat shell into the fastening section on a side of the mounting strut of the frame facing away from the seat shell and in a direction parallel to a longitudinal direction of the fastening section, wherein:

the clamping strip is fixed in an end position in the fastening section in a direction perpendicular to the plane of the seat shell.

* * * * *